US006145141A

United States Patent [19]

Whittington et al.

[11] Patent Number: 6,145,141

[45] Date of Patent: Nov. 14, 2000

[54] PORTABLE MOSQUITO NET APPARATUS AND METHOD OF SECURING TO A BED

[75] Inventors: Dale Whittington, Carrboro; Bryan W. Laffitte; Aly Khalifa, both of Raleigh, all of N.C.

[73] Assignee: Tropical Safety Research, Inc., Carrboro, N.C.

[21] Appl. No.: 09/305,392

[22] Filed: May 5, 1999

[51] Int. Cl.[7] ..... A47C 29/00; E04H 15/02; E04H 15/04

[52] U.S. Cl. ..... 5/414; 135/90; 135/116

[58] Field of Search ..... 5/414, 426; 135/90, 135/96, 116; 248/103, 105

[56] References Cited

U.S. PATENT DOCUMENTS

| | | | |
|---|---|---|---|
| 1,816 | 11/1864 | Palmer | 135/90 |
| 87,589 | 3/1869 | Platt | 5/414 |
| 180,732 | 8/1876 | Schapker | 135/90 |
| 665,126 | 1/1901 | Palmer | 5/414 |
| 692,419 | 2/1902 | Broun | 135/90 |
| 1,565,191 | 12/1925 | Nelson | 5/414 |
| 4,492,121 | 1/1985 | Williams | 5/414 |
| 4,852,598 | 8/1989 | Griesenbeck | 5/414 |
| 4,884,306 | 12/1989 | Goetz | 5/503.1 |
| 5,038,434 | 8/1991 | Navarette | 5/426 |
| 5,577,277 | 11/1996 | Sundberg et al. | 5/426 |

*Primary Examiner*—Alexander Grosz
*Attorney, Agent, or Firm*—Olive & Olive, P.A.

[57] ABSTRACT

A portable mosquito net apparatus is formed of a frame, adapted to be sandwiched between a bed mattress and a mattress support surface, typically a mattress spring, and is held in place by the weight of the mattress. The frame mounts a mosquito net support to which a mosquito net is attached in a position over the mattress. The mosquito net is draped down about the edges of the mattress to form an enclosed space. The frame, mosquito net support, and mosquito net can be easily disassembled for storage or transport in a small luggage bag.

17 Claims, 3 Drawing Sheets

PORTABLE MOSQUITO NET APPARATUS AND METHOD OF SECURING TO A BED

BACKGROUND OF THE INVENTION

1. Field of the Invention

The present invention relates generally to a mosquito net apparatus and its method of use to protect humans from insect bites, and more particularly to a portable mosquito net apparatus that is easily carried in a person's traveling bag or suitcase and quickly assembled and disassembled.

2. Background of the Prior Art

In today's international business climate, people are traveling to many different countries to do business. Furthermore, due to the relative ease of long distance travel, more tourists than ever are spending their vacations in countries throughout the world. However, in some of these countries insect populations are not well controlled and the occurrence of insect related human disease is high. Accommodations for people traveling in these countries may not adequately guard against insect infiltration into living quarters.

The female "Anopheles" mosquito is of particular concern because it often carries the plasmodium protozoa, four species of which infect human beings (the two most serious being "*P.vivax*" and "*P. falci parum*"), which when transmitted to humans via a mosquito bite causes malaria. Malaria is a disease characterized by cycles of debilitating chills, fever and sweating, that sometimes leads to death. If untreated, the disease can remain with an infected individual for his or her life, causing disease symptoms to return many times. Obviously, individuals traveling in countries with high incidences of malaria require effective protection against this disease. Taking a malaria prophylactic before traveling to such countries and over a substantial period of time can sometimes be an effective deterrent against plasmodium infection. However, malaria prophylactics are not 100% effective, and some individuals are unable to take them due to adverse side effects. Therefore, other means for preventing malaria and other insect transmitted diseases are needed.

Mosquito nets, if used properly, can provide an enclosed and substantially insect-free space, and are typically used to protect people while sleeping in bed from being bitten by mosquitos. There is a large amount of art related to mosquito nets and mosquito net devices. For example, U.S. Pat. No. 87,589 of Platt discloses a mosquito net device having a rigid single pole with a lower end fixedly attached to the bed frame head. A loop structure is attached to the upper end of the mosquito net device to better drape the netting around a bed. The mosquito net includes a series of rings arranged longitudinally along the net, which are also mounted along the pole.

Also, U.S. Pat. No. 1,816 of Palmer discloses a single rigid pole attached at its lower end to a base that rests on the floor underneath the bed. Other examples of patents that disclose mosquito net devices used in connection with beds are U.S. Pat. Nos. 180,732; 364,415; 503,954; 665,126; 1,565,191; 3,751,741 and 4,884,306.

It would be highly desirable for people traveling to countries with a high degree of mosquito infestation to bring along a mosquito net apparatus that is collapsible into a compact form that can be stored in a small travel bag or suitcase, and that can be easily assembled (and disassembled) and attached to a bed. None of the references identified above, or mosquito net devices known in the art, include such desirable features.

Accordingly, one object of the present invention is to provide a compact collapsible mosquito net apparatus that is especially adapted to be carried in a traveling bag or suitcase.

It is another object of the present invention to provide a portable, compact, collapsible mosquito net apparatus including a base that is sandwiched between a mattress and a mattress support surface and a single pole extending therefrom for attachment of a mosquito net in a position over the mattress.

It is still another object of the present invention to provide a portable mosquito net apparatus that can be easily and quickly assembled and disassembled.

SUMMARY OF THE INVENTION

According to the present invention, a portable, mosquito net support apparatus includes a frame having a first portion that fits between the mattress and the mattress support surface, for example, bed springs, approximately one-third down from the head of the bed, along one side of the mattress. The weight of the mattress firmly holds the first portion between the mattress and the mattress support surface. The frame also includes a second portion that extends beyond the mattress periphery to a location adjacent to an outside edge of the mattress. An elongate extendable pole is attached to the second portion such that the pole's upper end is positioned over the mattress. A mosquito net is attached to a centrally located cap with straps attached to the cap's top. The straps are removably attached to the extendable pole's end-hook such that the mosquito net is draped over the bed to form an enclosed space separating an occupant of the bed from insects located exterior to such space. The frame, pole, and mosquito net components of the invention are designed to be quickly assembled and disassembled, and once disassembled are easily carried inside a person's traveling bag or suitcase for convenient transport from one territory or location to another.

Other features and advantages of the invention will become apparent upon making reference to the specification, claims, and drawings to follow.

DETAILED DESCRIPTION OF PREFERRED EMBODIMENTS OF THE INVENTION

Figure 1:
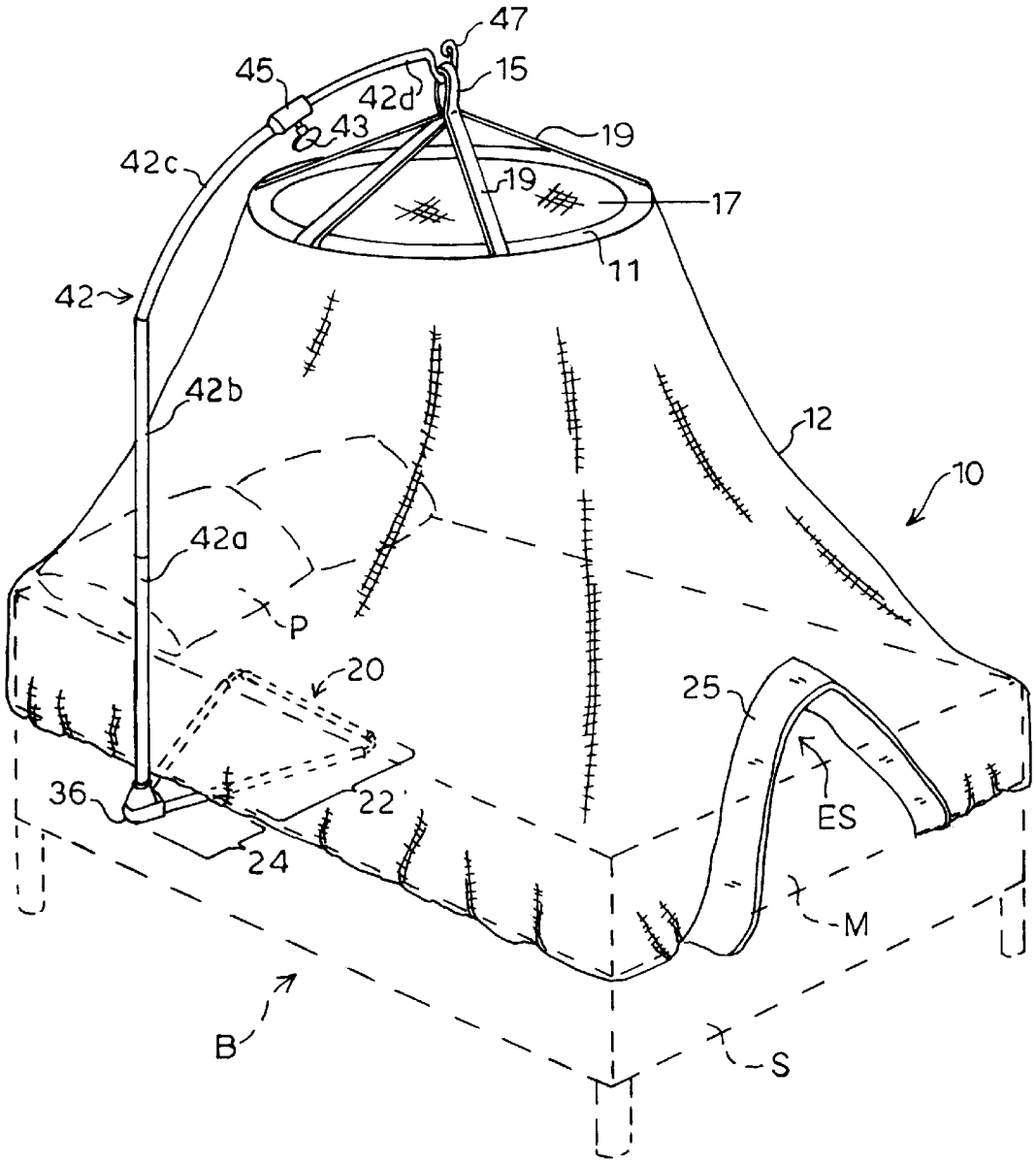
FIG. 1 is a perspective view of a first embodiment of the portable mosquito net apparatus of the present invention illustrated in use with a conventional bed, the bed being shown in dashed lines.

FIGS. 1–4 illustrate a first embodiment of the portable mosquito net apparatus 10 of the present invention. Referring first to FIG. 1, portable mosquito net apparatus 10 of the present invention is shown supporting mosquito net 12 over bed B comprised of mattress M and bedsprings S. The first embodiment of mosquito net apparatus 10 is comprised of triangular shaped frame 20 as shown assembled in FIG. 1. Frame 20 is comprised of a first portion 22 that is shown sandwiched between mattress M and bed springs S, and a second portion 24 that is shown extending beyond the outside edges of mattress M and mattress spring S at one side of bed B. Frame 20 is preferably placed approximately one-third down from the head of the bed along one side of the mattress. Second portion 24 of frame 20 includes pole support 36. A first end of pole 42 is mounted to pole support 36 such that pole 42 second end is located centrally above mattress M in a position over the pillow end of bed B. Pole 42 is collapsible into pole segments 42*a*, 42*b*, 42*c* that are interconnected by an elastic cord as is well known and generally used to pitch camping tents. Pole 42 also includes an extendable top portion 42*d* that mounts a first end into coupling 45 and has end-hook 47 at a second end that is rolled to prevent "poking" injuries. Top portion 42*d* is secured in place by thumb screw 43.

Mosquito net 12 is attached to bottom periphery 11 of a cloth cap 17. Cap 17 includes a resilient wire or plastic loop member (not shown) secured within its bottom periphery 11. The loop member is rigid enough to hold a circular shape during operation as shown in FIG. 1, but flexible enough to be folded upon itself to form a smaller circle for storage and transport. One way to form the smaller circle is to take cap 17 with loop member integral thereto and twist to form a figure-8 and then fold to form the smaller circle. Cap 17 has straps 19 attached at spaced intervals along its periphery 11 as shown in FIG. 1. Straps 19 are removably attached to the extendable pole's end-hook 47 such that the mosquito net 12 is draped over the bed to form an enclosed space ES separating an occupant in bed B from insects located exterior to such space. Furthermore, the stiffening member of periphery 11 located above the pillow end of bed B positions the sides of mosquito net 12 in a somewhat vertical position, preventing net 12 from draping close to or resting on an occupant's head residing on pillow P. Edge 25 of mosquito net 12 may be stretchable, including an elastic band (not shown) or the like that tightens against mattress M to better seal enclosed space ES. Alternatively, edge 25 of mosquito net 12 is simply tucked in around bed B to seal enclosed space ES as shown in FIG. 1.

Figure 8:
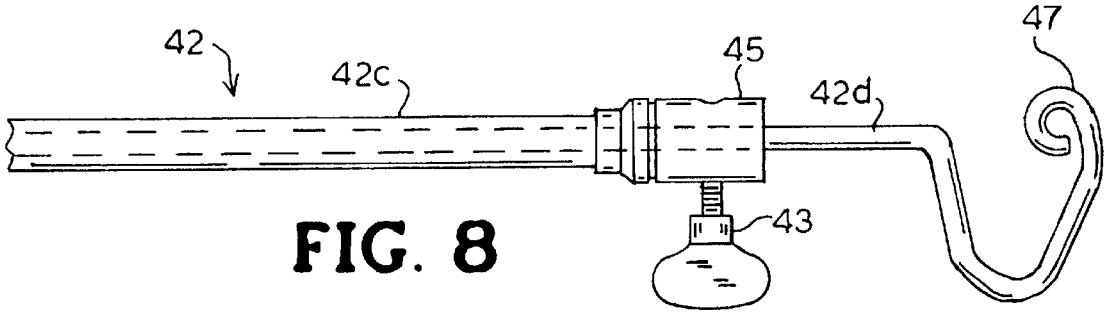
FIG. 8 is a partial view of the upper end of the extendable pole showing in detail the telescoping extension with end-hook of the present invention

Referring again to FIG. 1, pole 42 is formed of a bottom portion comprised of collapsible sections 42*a*, 42*b*, and 42*c* and a flexible telescoping top portion 42*d*. Sections 42*a* and 42*b* are substantially straight, whereas section 42*c* is formed with a slight arch such that top portion 42*d* with end-hook 47 is located centrally over bed B. Preferably sections 42*a* and 42*b* are flexible as well. Thus, when net 12 is connected to pole 42, sections 42*a* and 42*b* bend slightly toward the center of the bed. Referring to FIGS. 1 and 8, telescoping top portion 42*d* telescopes within section 42*c*. Set screw device such as thumb screw 43 may be loosened to allow extendable pole 42*d* to slide back and forth within bottom portion 42*c*. Thumb screw 43 is tightened against top portion 42*d* to hold top portion 42*d* in its operational position. Top portion 42*d* is also flexible so that it bends, towards a horizontal position such that end-hook 47 is positioned centrally over bed B, by the downward pull of mosquito net 12 being held tightly to periphery of bed B by an elasticized edge or, alternatively, by its tucked in non-elasticized edge 25.

Although the present invention describes use of pole 42, the present invention recognizes that any mosquito net support could be used. For example, mosquito net support could be formed such that pole 42 is angled along its length, instead of curved, preferably at its upper end so that hook 47 is centrally located over bed B. A more complicated multi-member mosquito net support device adapted to extend from support 36 of second portion 24 of frame 20 could also be used to secure and drape mosquito net 12 over bed B.

Figure 2:
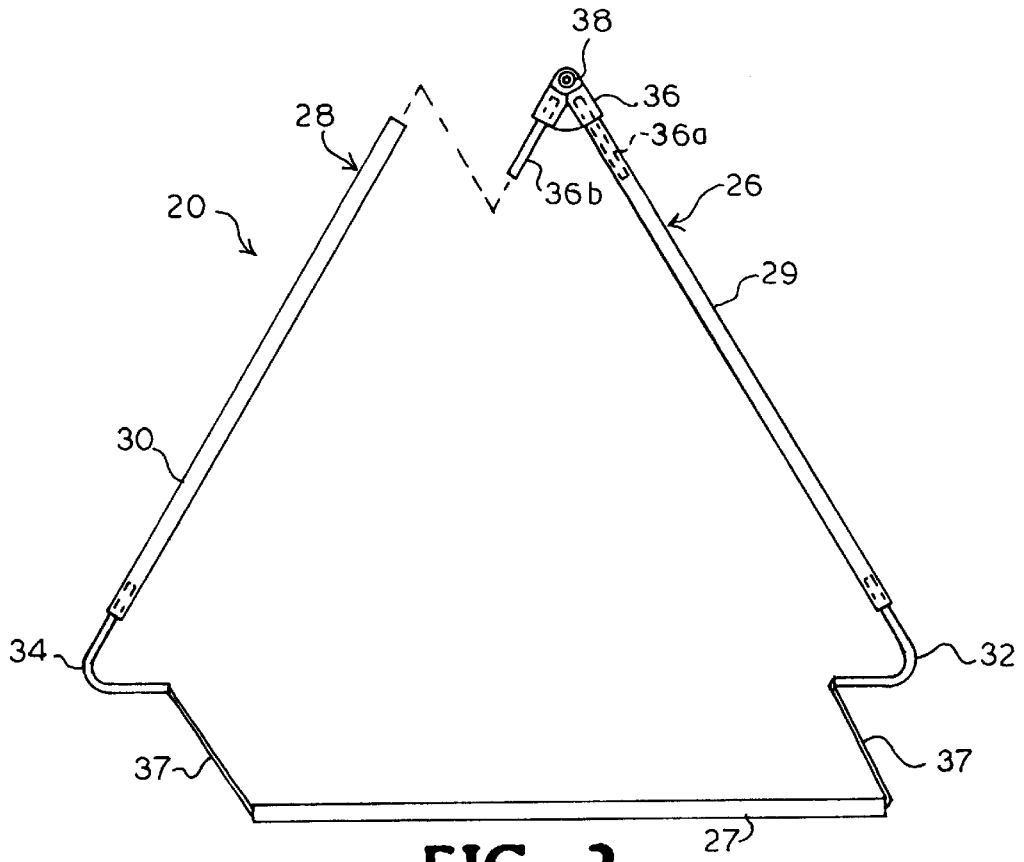
FIG. 2 is a partially exploded plan view of a triangular shaped frame of the first embodiment of the present invention.
Figure 4:
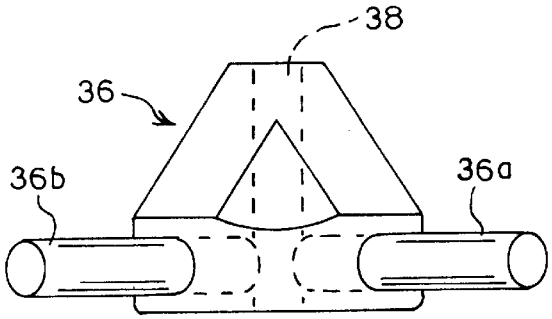
FIG. 4 is an enlarged front elevation view of the pole receiving support member of the triangular shaped frame of FIG. 2.

Frame 20 is shown in more detail in the exploded view of FIG. 2. Frame 20 is comprised of a first side member 26, a base member 27, and a second side member 28. First and second side members 26 and 28 include elongate tubes 29 and 30, respectively. Solid rods or any other elongate rigid members of appropriate dimensions, shape, weight, and strength may be substituted for tubes 29 and 30. First and second side members 26 and 28 also include corners 32 and 34 permanently attached to the respective lower ends of elongate tubes 29 and 30. First side member 26 further includes pole support 36. Pole support 36 includes extensions 36*a* and 36*b* that extend angularly to form a corner. Pole support 36 is permanently attached to the upper end of elongate tube 29 by extension 36*a*, such that first member 26 is comprised of corner 32 and pole support 36 permanently attached to opposed ends of elongate tube 29. Second member 28 is comprised of elongate tube 30 with corner 34 permanently attached to its lower end. FIG. 4 shows a front elevation view of pole support 36. Pole support 36 is shown with extensions 36*a*, 36*b* previously discussed, and a central channel 38 for receiving pole 42 or other mosquito net support device.

Flexible cord 37 (shown in FIG. 2 in a stretched position) is permanently attached to first and second corners 32 and 34, respectively, interconnecting first and second members 26 and 28. Flexible cord 37 extends through tubular base 27. Thus, to assemble frame 20, flexible cord 37 retracts such that opposed ends of base 27 releasably mate with respective corners 32 and 34. The upper end of elongate tube 30 mates with extension 36*b* to form an integral triangular base 20 as shown assembled in FIG. 1.

Figure 3:
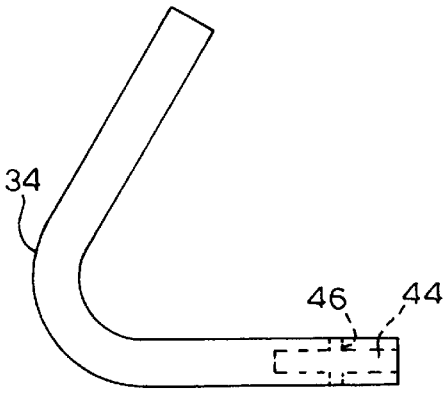
FIG. 3 is an enlarged plan view of a corner component of the triangular shaped frame of FIG. 2.

FIG. 3 illustrates corner 34 in more detail. Corner 34 includes an elastic cord channel 44. Elastic cord channel 44 is adapted to receive one end of elastic cord 37. Corner 34 also includes pin channel 46. Attachment pin (not shown) is permanently inserted through pin channel 46 and elastic cord 37 therein, permanently affixing elastic cord 37 to corner 34. Corner 32 is identical in construction to corner 34 and, therefore, for simplicity, corner 32 is not illustrated separately. Corner 32 also includes an elastic cord channel, pin channel, and pin for permanently affixing one end of elastic cord 37 thereto. Elastic cord 37 links first side member 26, second side member 28, and base member 27 together, preventing them from being separated or lost when disassembled for storage or transport.

Referring again to FIG. 1, once triangular frame 20 is assembled, the user simply places triangular frame 20 between mattress M and a mattress support surface, typically mattress springs S, so that pole support 36 extends beyond the edge of mattress M and springs S. Depending on the particular sleeping accommodations available, it is understood that the mattress support surface could be a floor, a piece of plywood, or any other support surface capable of supporting a bed mattress. In addition, it is also recognized by the present invention that frame 20 is formed to be placed directly on a floor with a weight, such as a suitcase, placed on the top of frame 20 to firmly hold it to the floor in a correct operational position with mattress M or other sleeping area. The preferred operational position is as described above, frame 20 being preferably placed approximately one-third down from the head of the bed along one side of and adjacent the mattress. It is also recognized by the present invention that frame 20 can be weighted itself such that mosquito net apparatus 10 of the present invention is self-standing. However, the additional weight of frame 20 would likely make the apparatus of the invention less portable.

The user then extends pole 42 and inserts its lower end into central channel 38 of pole support member 36. Next, the user hooks mosquito net 12 straps 19 to end-hook 47 of pole 42 as discussed above or by other attachment means as are clearly well known in the art. After triangular frame 20, vertical pole 42, and mosquito net 12 are assembled together, and mosquito net apparatus 10 of the invention is held in place by the weight of mattress M upon triangular frame 20, the user drapes mosquito net 12 over mattress M and down beyond the edges thereof and tucks edge 25 between mattress M and support surface such as mattress spring S to form an enclosed space ES separating an occupant located therein from insects located exterior of enclosed space ES. User may retract or extend top portion 42*d* to better position end-hook 47 centrally over bed B. Transport is easily achieved by disassembling frame 20, pole 42, folding mosquito net 12 and bundling them together in a discrete package that can be placed within an airline carry-on bag or other piece of luggage.

Figure 5:
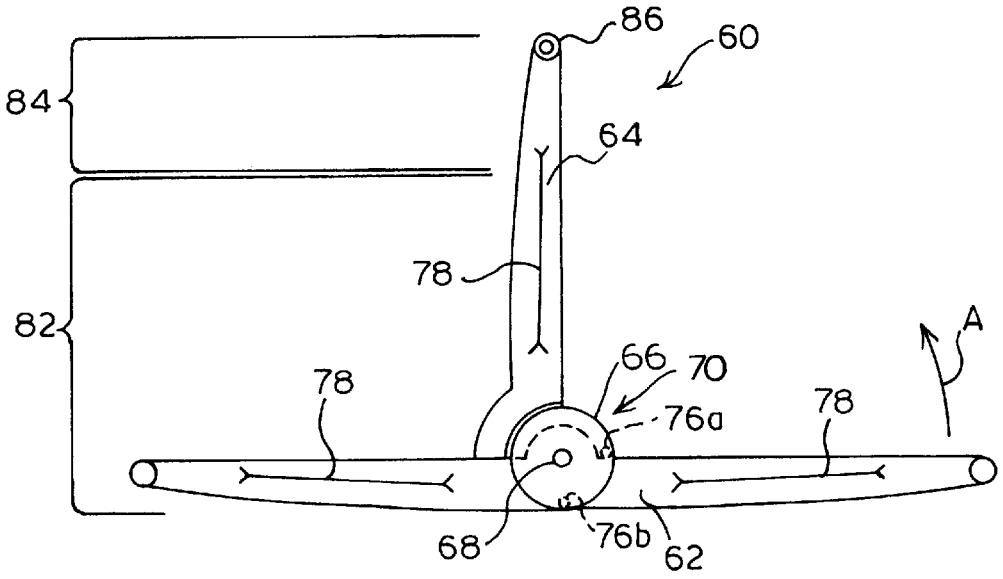
FIG. 5 is a plan view of the base member of the second embodiment of the present invention shown in its operational T-shaped position.
Figure 7:
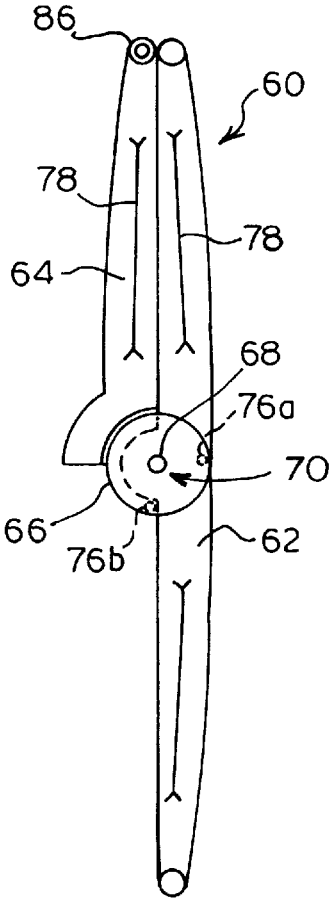
FIG. 7 is a plan view of the base member of the second embodiment of the present invention shown in its portable position.
Figure 6:
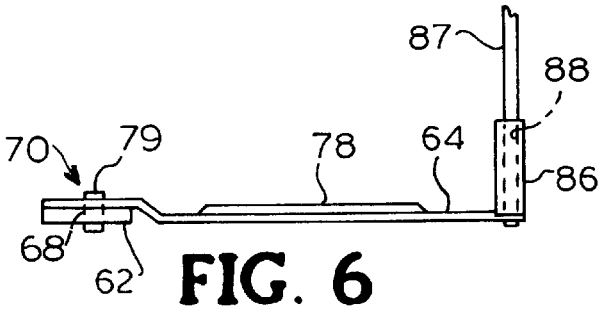
FIG. 6 is a side elevation view of a portion of the base member of the second embodiment of FIG. 5.

FIGS. 5–7 illustrate the second embodiment of the portable mosquito net apparatus of the present invention. Referring to FIG. 5, the triangular shaped frame 20 of the first embodiment is replaced in the second embodiment with a T-shaped frame 60 comprised of base member 62 and arm 64 rotatably connected thereto substantially at the mid-point of base member 62. Arm 64 includes circular head 66, which encompasses pivot point 70. Aperture 68 extends through pivot point 70 of circular head 66 and base member 62 as shown in FIG. 6. Pin 79 (FIG. 6) or other suitable connector extends through aperture 70, and rotatably secures base member 62 to arm 64. Spring ball mechanisms 76*a* and 76*b*, as are well known in the art, are located on the periphery of circular head 66. Referring to FIG. 5, when frame 60 is in its T-shaped operative position, spring ball mechanism 76*a* engages the upper edge of base member 62. Base member 62 is rotated in the direction of arrow A as shown in FIG. 5 to a collapsed position. In the collapsed position of frame 60 as shown in FIG. 7, spring ball mechanism 76*b* engages upper edge of base member 62. Spring ball mechanisms 76*a* and 76*b* prevent arm 64 and base member 62 from freely rotating, significantly reducing the danger of a user's fingers getting pinched therebetween. Ribs 78 add strength to base member 62 and arm 64. Also illustrated by FIG. 6 is pole 87 mounted within pole receptacle 86 at the outermost end of arm 64.

Similar to the first embodiment of the invention and therefore referring to both FIGS. 1, 5, and 6 the T-shaped frame 60 of the second embodiment has a first portion 82 that, during operation, is sandwiched between mattress M and a support surface, e.g. mattress spring S. Arm 64 has a second portion 84 that extends past the edge of mattress M. In accordance with the second embodiment of the present invention, an extendable pole 87 (identical to pole 42 of the first embodiment of the present invention) is placed into pole receptacle 88 of pole mount 86. A mosquito net identical to mosquito net 12 of the first embodiment is attached to the upper end of pole 87 and is draped downward over mattress M and about the edges thereof in an identical manner as already illustrated in FIG. 1. To disassemble, the mosquito net is detached from pole 87 and pole 87 is removed from frame 60. Frame 60 is removed from beneath the mattress and rotatable arm 64 and base member 62 are rotated until aligned to a portable position as shown in FIG. 7. Frame 60, pole 87, and mosquito net 12 are then formed into a discrete package for transport in an airline carry on bag or piece of luggage. The first and second embodiments of the present invention may be inserted in a nylon bag or other suitable case to prevent the component parts of the invention from being separated during travel.

While the invention has been described with reference to specific embodiments thereof, it will be appreciated that numerous variations, modifications, and embodiments are possible, and accordingly, all such variations, modifications, and embodiments are to be regarded within the spirit and scope of the invention.

What is claimed is:

1. A portable mosquito net apparatus for positioning a mosquito net over a mattress supported on a mattress support surface, comprising:

a) a frame formed of three elongate rigid members connected to one another at their respective ends;

b) said frame having first and second portions, wherein said first portion of said frame is sandwiched between a mattress and a mattress support surface and said second portion extends beyond the mattress;

c) a mosquito net support removably mounted to said second portion of said frame; and d) means of attaching a mosquito net to said mosquito net support.

2. A portable mosquito net apparatus as recited in claim 1, wherein said mosquito net support is comprised of an elongate pole having a first end removably mounted to said second portion of said frame.

3. A portable mosquito net apparatus as recited in claim 2, wherein said pole is arched.

4. A portable mosquito net apparatus as recited in claim 2, wherein said pole includes bottom and top portions, wherein said top portion includes an end-hook.

5. A portable mosquito net apparatus as recited in claim 4, further comprising a cloth cap having straps fixedly attached at a first end to said cloth cap and releasably attached at a second end to said end-hook, said cloth cap further having a flexible loop member integral to its periphery.

6. A portable mosquito net apparatus as recited in claim 5, wherein said mosquito net is attached to said periphery of said cloth cap.

7. A portable mosquito net apparatus as recited in claim 4, wherein said top portion telescopes within said bottom portion.

8. The portable mosquito net apparatus of claim 2, wherein said pole is comprised of a series of collapsible segments interconnected by an elastic cord.

9. A portable mosquito net apparatus as recited in claim 1, wherein said three elongate rigid members are interconnected at their ends to form triangle-shaped frame.

10. A portable mosquito net apparatus as recited in claim 9, wherein said three members are interconnected by an elastic cord.

11. A portable mosquito net apparatus as recited in claim 9, wherein said three members are configured so as to be disassembled for transport or storage.

12. The portable mosquito net apparatus of claim 1, wherein said mattress support surface is a mattress spring.

13. The portable mosquito net apparatus of claim 1, wherein said mosquito net further comprises an elastic periphery.

14. A portable mosquito net apparatus comprising:

a) a first side member, a base member; and a second side member interconnected to form a triangular frame having an apex where said first and second side members converge, b) an elongate pole having first and second ends, said first end being removeably mounted to said apex of said frame; and c) a mosquito net attached to said second end of said pole.

15. The portable mosquito net apparatus of claim 14, wherein said pole is comprised of a series of collapsible segments interconnected by an elastic cord.

16. The portable mosquito net apparatus of claim 14, wherein said frame is able to be disassembled into detached said first side, said base, and said second side members interconnected by an elastic cord.

17. A method of securing a portable mosquito net apparatus to a bed comprised of a mattress and mattress support surface, comprising the steps of:

a) placing a frame comprising three elongate rigid members connected to one another at their respective ends, between a mattress and a mattress support surface;

b) extending a portion of said frame beyond the mattress;

c) securing a mosquito net support to the portion of the frame that extends beyond the mattress;

d) securing a mosquito net to said mosquito net support; and e) positioning said mosquito net over the mattress.

* * * * *